US007918623B2

(12) United States Patent
Lacroix et al.

(10) Patent No.: US 7,918,623 B2
(45) Date of Patent: Apr. 5, 2011

(54) CABLED MAT SYSTEM WITH REMOVABLE BLOCKS

(75) Inventors: David M. Lacroix, Saint Paul, MN (US); Joseph V. Salerno, Logan Twp, NJ (US)

(73) Assignee: Contech Earth Stabilization Solutions Inc., West Chester, OH (US)

( * ) Notice: Subject to any disclaimer, the term of this patent is extended or adjusted under 35 U.S.C. 154(b) by 283 days.

(21) Appl. No.: 12/171,665

(22) Filed: Jul. 11, 2008

(65) Prior Publication Data

US 2009/0123228 A1 May 14, 2009

Related U.S. Application Data

(60) Provisional application No. 60/949,607, filed on Jul. 13, 2007.

(51) Int. Cl.
*E01C 15/00* (2006.01)

(52) U.S. Cl. ..... 404/35; 404/40; 404/41; 405/27; 405/302.4

(58) Field of Classification Search ..... 404/34, 404/35, 40, 41; 405/16, 17, 302.4; 52/604, 52/607

See application file for complete search history.

(56) References Cited

U.S. PATENT DOCUMENTS

| | | | | |
|---|---|---|---|---|
| 117,802 | A * | 8/1871 | Mulford | 404/38 |
| 4,370,075 | A * | 1/1983 | Scales | 405/20 |
| 4,372,705 | A * | 2/1983 | Atkinson | 405/19 |
| 4,375,928 | A * | 3/1983 | Crow et al. | 405/20 |
| RE32,663 | E * | 5/1988 | Atkinson | 405/19 |
| 5,484,230 | A | 1/1996 | Rudloff | |
| 5,702,208 | A * | 12/1997 | Hilfiker et al. | 405/302.4 |
| 6,416,253 | B1 * | 7/2002 | Wimp et al. | 405/172 |
| 6,508,607 | B1 * | 1/2003 | Smith et al. | 405/20 |
| 6,558,074 | B2 * | 5/2003 | Jansson | 405/16 |
| 6,579,038 | B1 * | 6/2003 | McAllister et al. | 405/16 |
| 6,866,446 | B2 | 3/2005 | McAllister et al. | |
| 6,955,500 | B1 * | 10/2005 | Smith et al. | 405/20 |
| 7,037,037 | B1 * | 5/2006 | Smith et al. | 405/20 |
| 7,344,334 | B2 * | 3/2008 | Thorkelson | 404/29 |

FOREIGN PATENT DOCUMENTS

DE 821045 11/1951

OTHER PUBLICATIONS

PCT, International Search Report and Written Opinion, PCT/US2008/069721 (Oct. 2, 2008).

* cited by examiner

*Primary Examiner* — Gary S Hartmann
(74) *Attorney, Agent, or Firm* — Thompson Hine LLP

(57) ABSTRACT

A mat system includes a surface and at least first and second mat units. Each mat unit includes a respective plurality of blocks interlinked by respective cables that pass through the blocks. Each mat unit includes cable loops along at least one side section thereof. The first and second mat units are positioned on the surface in proximity to each other with cable loops of the first mat unit extending toward the second mat unit and cable loops of the second mat unit extending toward the first mat unit. A plurality of interconnecting blocks are positioned between the first mat unit and the second mat unit. Each interconnecting block includes an underside with downwardly open channels formed therein. The cable loops of the first and second mat units are positioned within the channels of the interconnecting blocks to cover the cable loops. The interconnecting blocks and the blocks forming the first and second mat units are sized, shaped and positioned such that upper surfaces thereof form a substantially continuous surface.

19 Claims, 12 Drawing Sheets

CABLED MAT SYSTEM WITH REMOVABLE BLOCKS

CROSS-REFERENCE TO RELATED APPLICATIONS

This application claims priority to U.S. Provisional Patent Application Ser. No. 60/949,607, filed Jul. 13, 2007, the details of which are hereby incorporated by reference as if fully set forth herein.

TECHNICAL FIELD

The present application relates generally to a cabled mat system and, in particular, a cabled mat system with removable blocks.

BACKGROUND

Mat systems are typically formed by interconnecting numerous, individual blocks to form mat sections. Often the blocks are formed of concrete to provide a concrete mat. A cable is disposed through the blocks to interconnect the blocks of the sections. The mat sections are then connected together using grout or other hardening material to form the mat. The mats may be used for a variety of purposes, such as to inhibit soil erosion or to control soil heaving. Because the mat sections are interconnected by a hardened material and cable, it can be difficult to remove the mat or to break the mat apart, for example, in order to repair earth beneath the mat.

SUMMARY

In an aspect, a mat system includes a surface and at least first and second mat units. Each mat unit includes a respective plurality of blocks interlinked by respective cables that pass through the blocks. Each mat unit includes cable loops along at least one side section thereof. The first and second mat units are positioned on the surface in proximity to each other with cable loops of the first mat unit extending toward the second mat unit and cable loops of the second mat unit extending toward the first mat unit. A plurality of interconnecting blocks are positioned between the first mat unit and the second mat unit. Each interconnecting block includes an underside with downwardly open channels formed therein. The cable loops of the first and second mat units are positioned within the channels of the interconnecting blocks to cover the cable loops. The interconnecting blocks and the blocks forming the first and second mat units are sized, shaped and positioned such that upper surfaces thereof form a substantially continuous surface.

In another aspect, a method of forming a mat system includes forming a plurality of mat units by arranging blocks in multiple rows and interconnecting the blocks using cables with cable loops being exposed at an edge of the mat units. The mat units are arranged end-to-end such that cable loops of the end-to-end mat units face each other. An interconnecting block is placed between the ends of the end-to-end mat units such that the interconnecting block releasably engages cable loops of the end-to-end mat units to inhibit lateral movement of the end-to-end mat units relative to each other.

In another aspect, a mat system includes a plurality of mat units arranged side-by-side. Each side-by-side mat unit includes a respective plurality of blocks interlinked by respective cables that pass through the blocks. Each side-by-side mat unit includes exposed cable portions along at least one side section thereof. The side-by-side mat units are positioned on a surface in proximity to each other with exposed cable portions of the side-by-side mat units facing each other. A plurality of interconnecting blocks are positioned between the side-by-side mat units. Each interconnecting block includes an underside with downwardly open channels formed therein. The exposed cable portions of the side-by-side mat units positioned within the channels of the interconnecting blocks to cover the exposed cable portions. The interconnecting blocks and the blocks forming the side-by-side mat units form a substantially continuous surface.

The details of one or more embodiments are set forth in the accompanying drawings and the description below. Other features, objects, and advantages will be apparent from the description and drawings.

DETAILED DESCRIPTION

Figure 1:
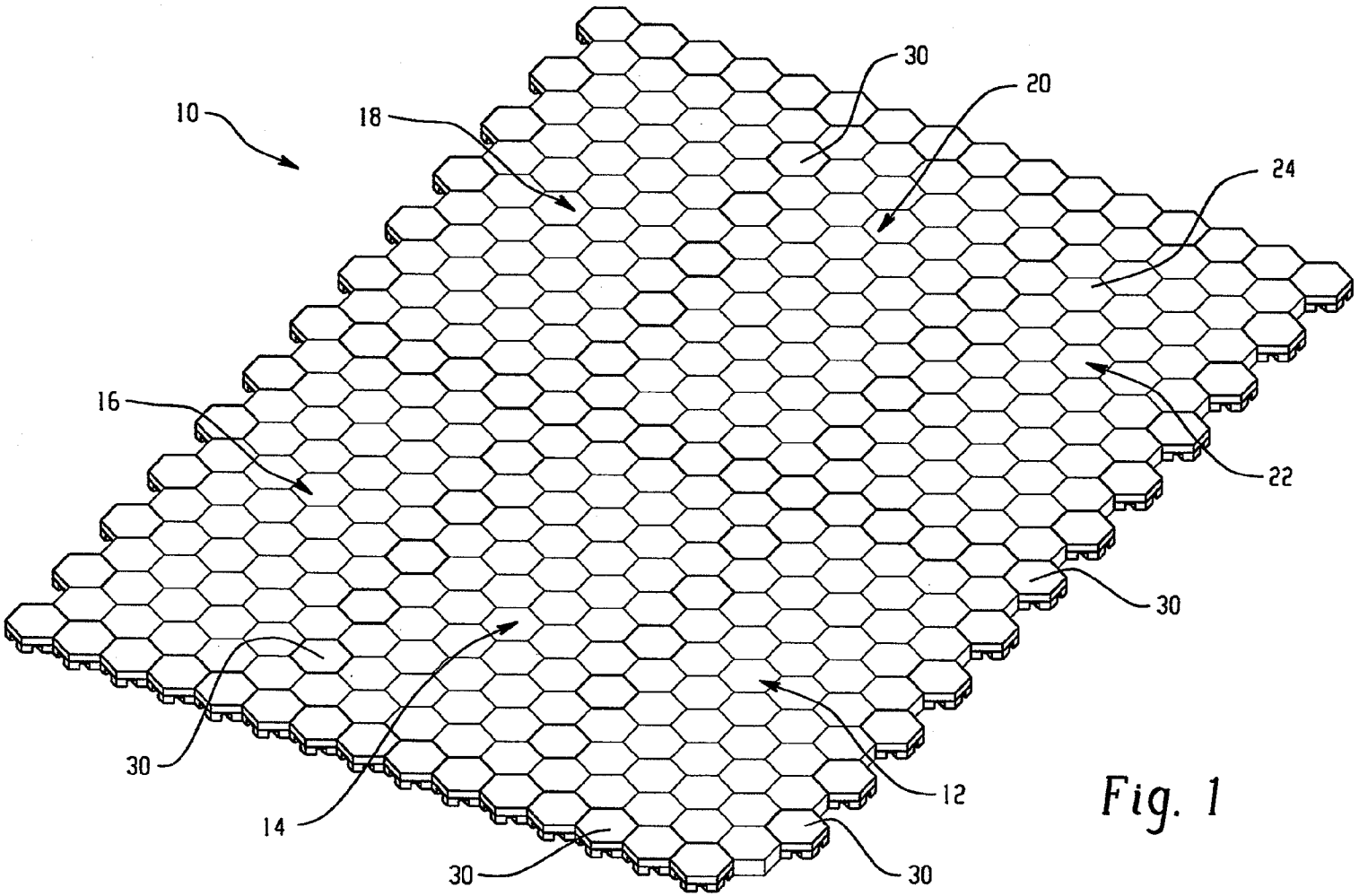
FIG. 1 is a perspective, top view of an embodiment of a mat system including removable blocks.

Referring to FIG. 1, a mat system 10 includes interconnected sections 12, 14, 16, 18, 20 and 22 of individual blocks 24 (e.g., formed of concrete or other suitable material). While the mat system is illustrated as including six sections, forming a rectangular mat, the number of sections can vary depending on the desired end use. For example, the mat system 10 may include more than six sections or less than six sections. Also, the mat system may be a shape other than rectangular, such as rounded or a combination of contours.

As will be described with reference to FIG. 2, the blocks 24 of each section 12, 14, 16, 18, 20, 22 are interconnected by cables 26 by passing the cables through openings 28 that extend laterally through each block 24. The mat system 10 also includes blocks 30 (represented by a darker shade than that representing blocks 24), which interconnect adjacent sections 12, 14, 16, 18, 20, 22. The blocks 30 may be formed of concrete and are removable from the mat system 10 and will hereafter be referred to as removable blocks 30. By "removable," we mean that the blocks 30 can be individually removed from the mat system 10 without breaking through material forming the mat system, cutting through and/or removing one or more of the cables 26 of the mat system. In contrast, blocks 24 will hereafter be referred to as non-removable blocks 24. By "non-removable," we mean that some breaking, cable removal and/or cutting operation must be performed before an individual block 24 can be removed from the mat system 10.

As noted above, referring to FIG. 2 showing a bottom view of the mat system 10, the blocks 24 are interconnected by cables 26. Referring also to FIG. 3, the cables 26 run through openings 28*a* and 28*b* (e.g., tubular openings) that encircle the respective cable. The openings 28 are formed through the body 32 of the blocks 24 such that to separate the blocks 24 from the cable without damaging the associated blocks, the cable must be pulled from the openings.

Figure 2:
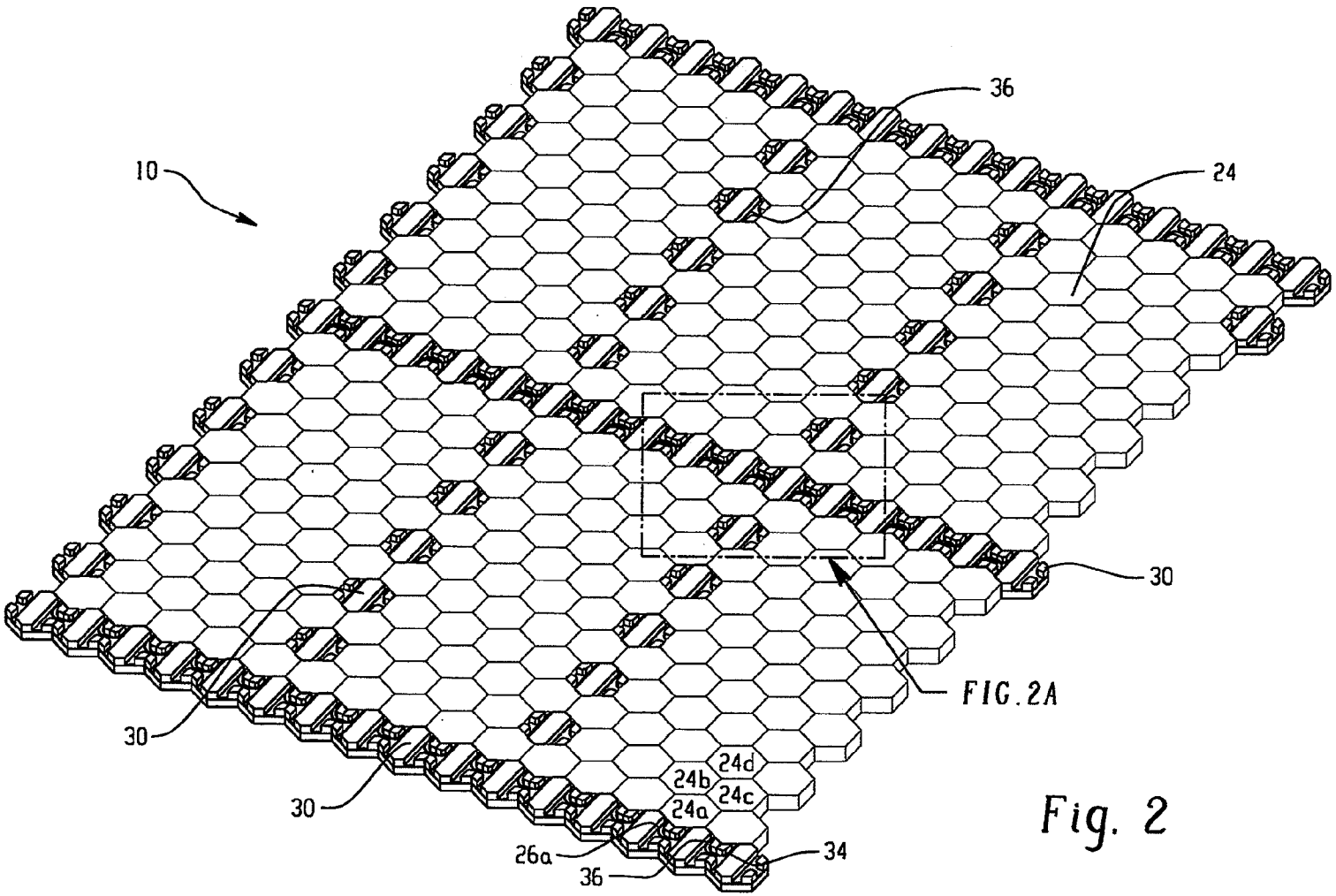
FIG. 2 is a perspective, bottom view of the mat system of FIG. 1.
Figure 2A:
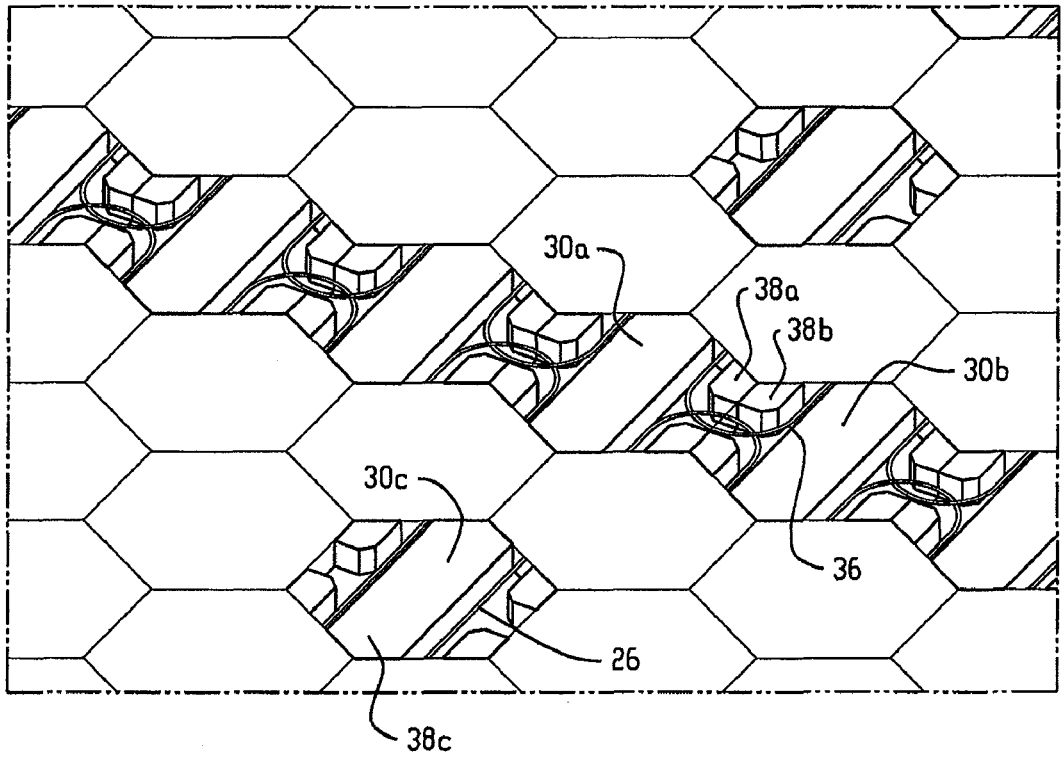
Figure 3:
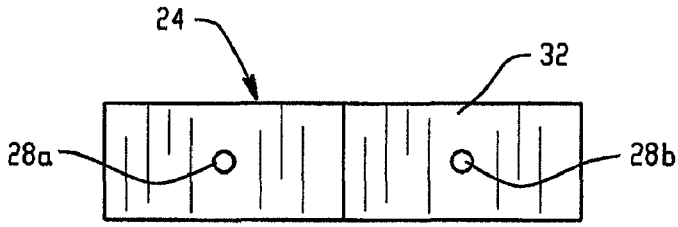
FIG. 3 is a side elevation of a mat section block including cable openings.

Referring to FIG. 2, the cables 26 run through adjacent rows of blocks 24 to interconnect the rows. For example, cable 26*a* passes through respective, aligned openings 28*a* and 28*b* in blocks 24*a*, 24*b*, 24*c*, 24*d* and so on. At the end of the rows, the cables 26 loop from opening 28*a* to opening 28*b* thereby forming loops 34 and 36 at each row end. As can be seen in the detail view of FIG. 2, the loops pass around connecting members 38 of adjacent removable blocks 30 (e.g., see removable blocks 30*a* and 30*b* along with associated connecting members 38*a* and 38*b*). Cables 26 also pass by connecting members 38 of removable blocks 30 located between ends of the rows (e.g., see block 30*c* and connecting members 38*c*). As may be appreciated, the removable blocks 30 located at the end of the rows connect end-to-end sections (e.g., section 12 and section 22) and the removable blocks 34 located between the ends of the rows connect side-by-side sections (e.g., sections 12 and section 14).

Each mat section 12, 14, 16, 18, 20 and 22 is formed as an individual mat unit comprised of multiple blocks 24 linked together by the cables, so that each mat unit can be lifted, transported and placed as desired.

Figure 4:
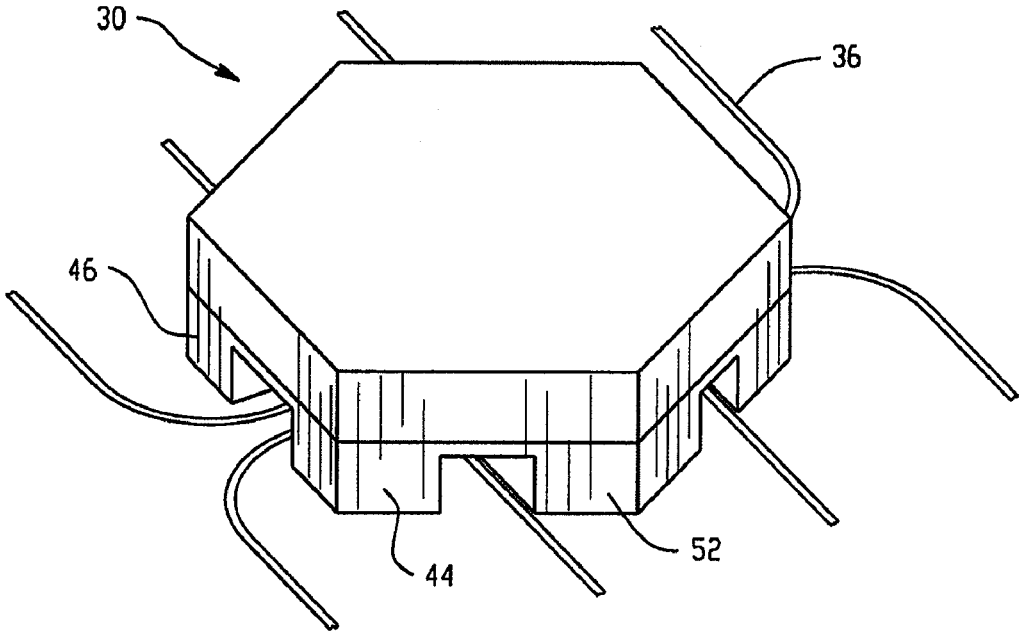
FIGS. 4 and 5 are perspective, top and bottom views, respectively, of the removable block of FIG. 1 including cables.
Figure 5:
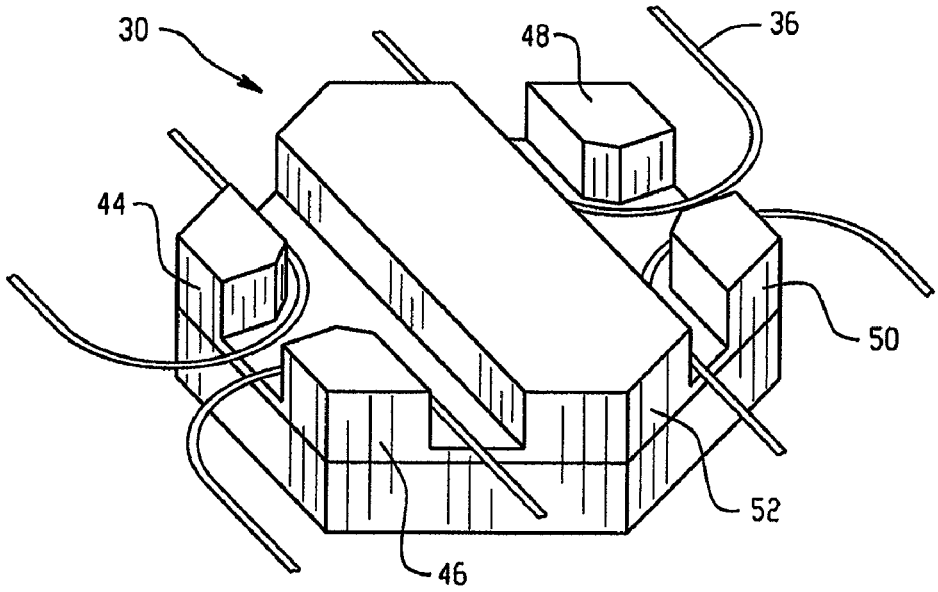
Figure 6:
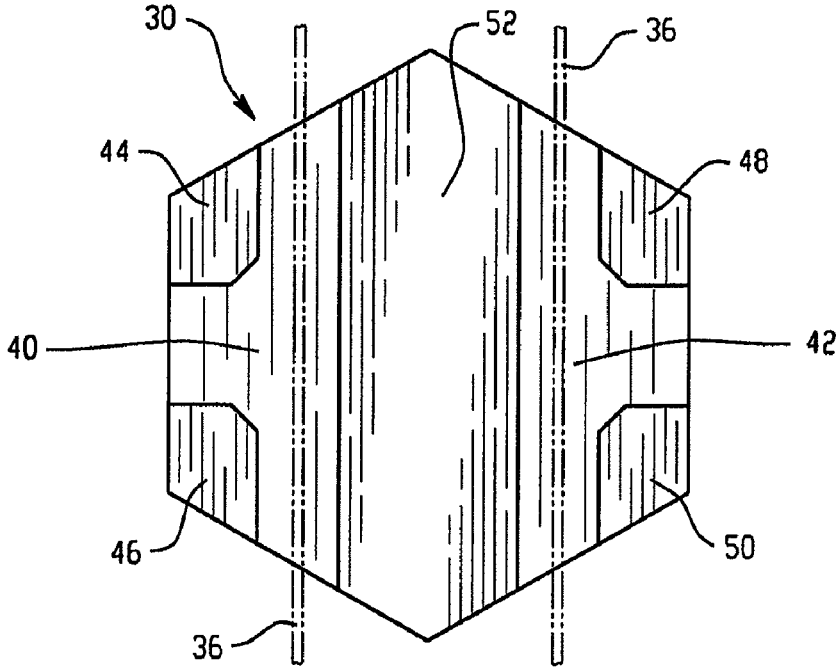
FIG. 6 is a bottom view of the removable block of FIG. 4.
Figure 7:
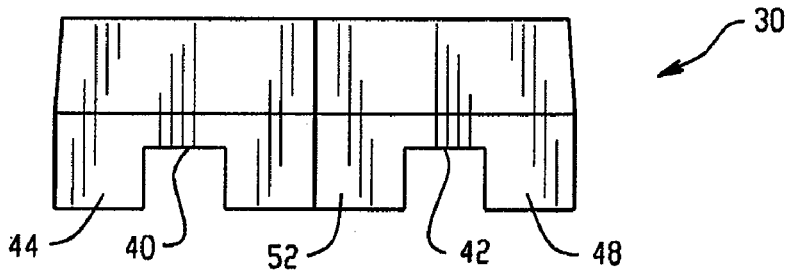
FIGS. 7 and 8 are end views of the removable block of FIG. 4.
Figure 8:
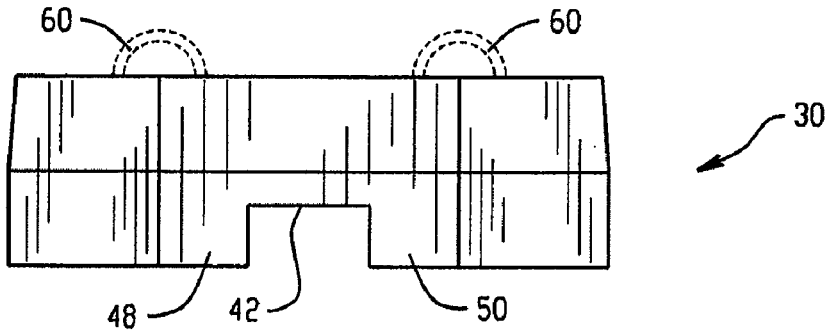

FIGS. 4-8 show the removable block 30 in isolation with FIGS. 4 and 5 showing the removable blocks along with exposed cables 36 and FIGS. 6-8 showing the removable blocks without the exposed cables. The removable blocks 30 include T-shaped channels 40 and 42 that form the connecting members 38. The connecting members 38 include side extensions 44, 46, 48 and 50 that are located at opposite sides of an elongated central extension 52. The cables 36 of end-to-end sections hook the side extensions 44, 46, 48 and 50, thereby connecting the end-to-end sections as shown by FIGS. 4 and 5. The cables 36 of side-by-side sections pass alongside opposite sides of the central extension 52, thereby connecting the side-by-side sections as represented by the dotted lines of FIG. 6. As can be seen, this arrangement provides freedom to remove the removable blocks 30 by lifting the removable blocks vertically from the cables 36.

Referring back to FIG. 1, to assemble the mat system 10, the sections 12, 14, 16, 18, 20 and 22 are positioned side-by-side and end-to-end with the cables 36 running through the openings 28 as described above. The positioning can be achieved by using one or more of the extending cable loops of each section to lift and place the section. Then, the removable blocks 30 are dropped into place as shown thereby interconnecting the side-by-side sections 12 and 14, 14 and 16, 18 and 20, 20 and 22 and end-to-end sections 12 and 22, 14 and 20, 16 and 18 to create a continuous block surface with the cables covered. The removable blocks may limit lateral movement of the mat sections relative to each other. The removable blocks 30 may thereafter be removed from the mat system 10 by lifting the removable blocks vertically, providing simple access to the cable loops so that the mat sections can be readily lifted and moved, if desired, for example, to repair the earth thereunder. Once a repair has been made, the mat sections can be replaced and the removable blocks 30 again used to complete the mat surface and cover the cables.

Figure 9:
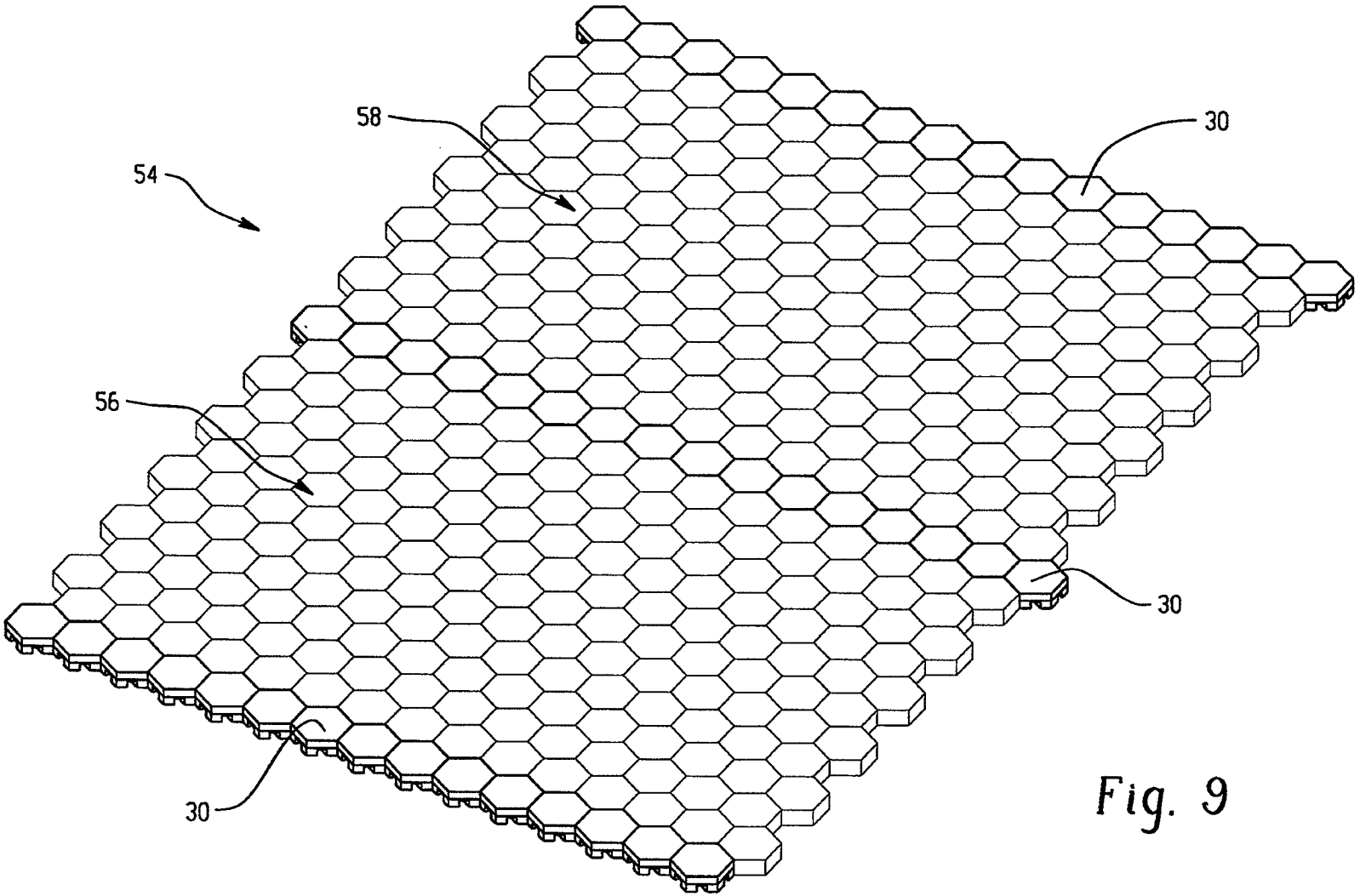
FIGS. 9 and 10 are perspective, top and bottom views, respectively, of another embodiment of a mat system including removable blocks.
Figure 10:
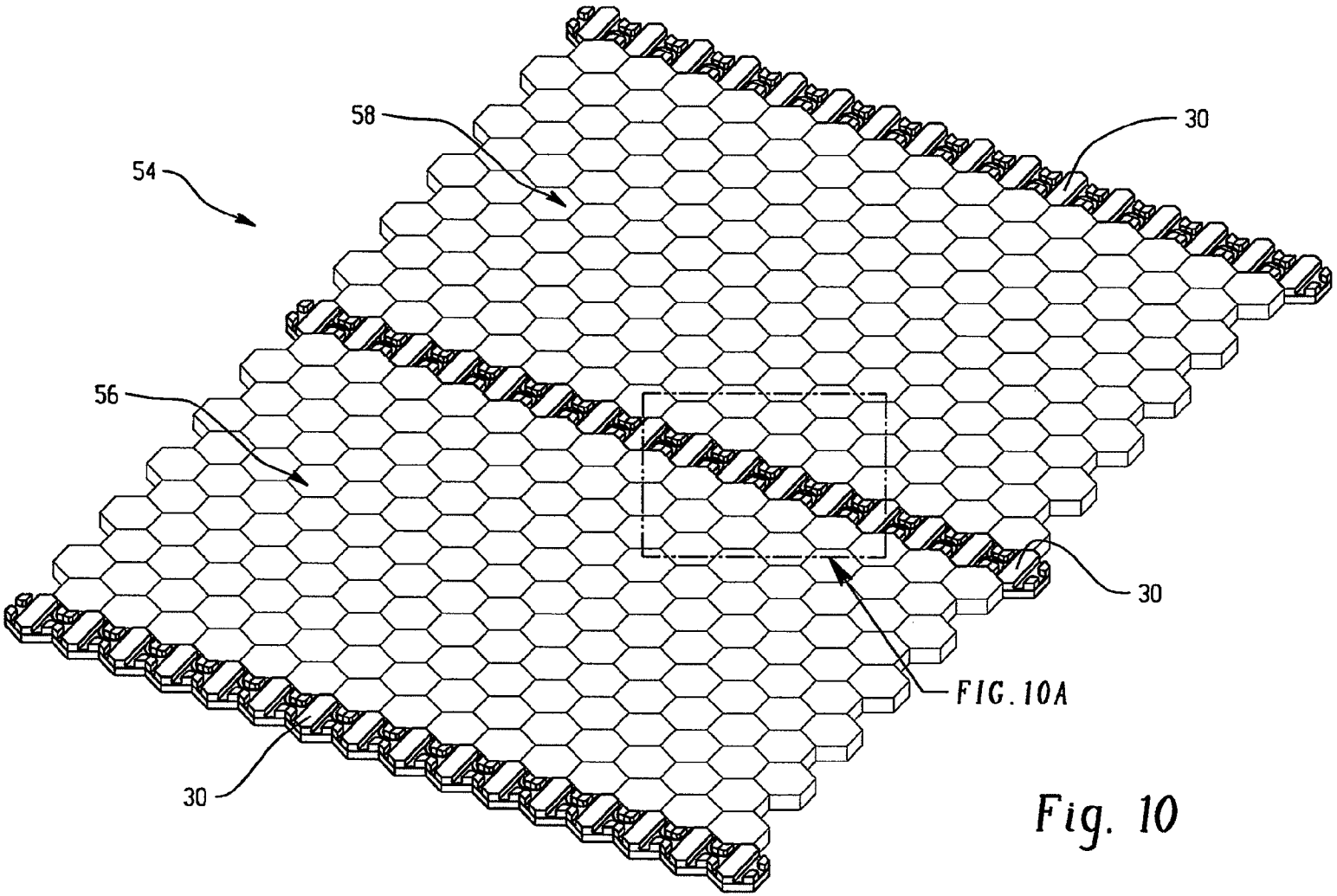
Figure 10A:
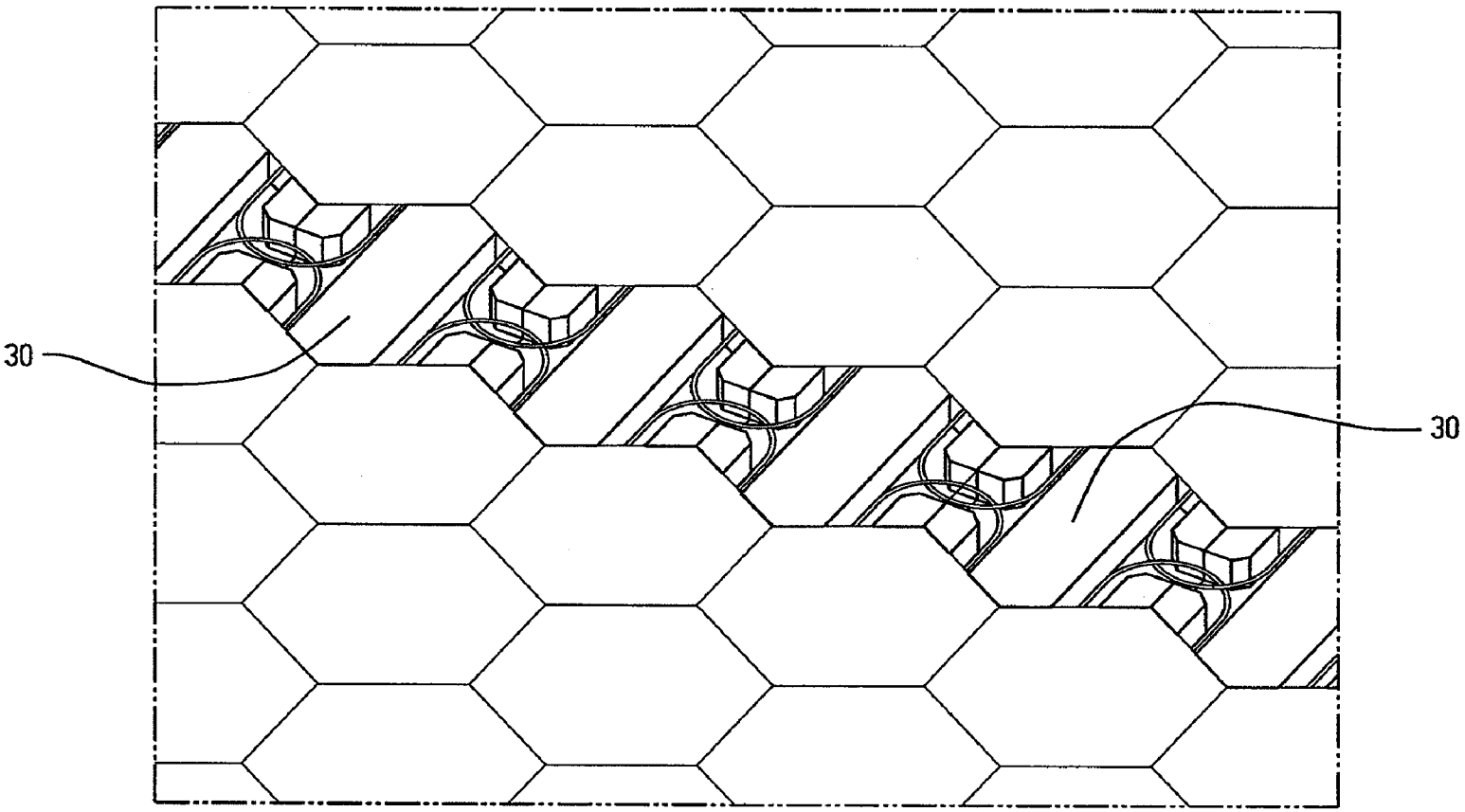
Figure 12:
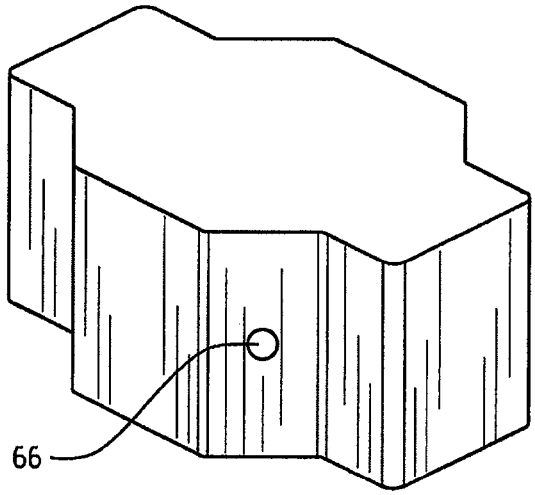
FIGS. 11-20 illustrate alternative block designs and mat systems formed using the alternative block designs.
Figure 11:
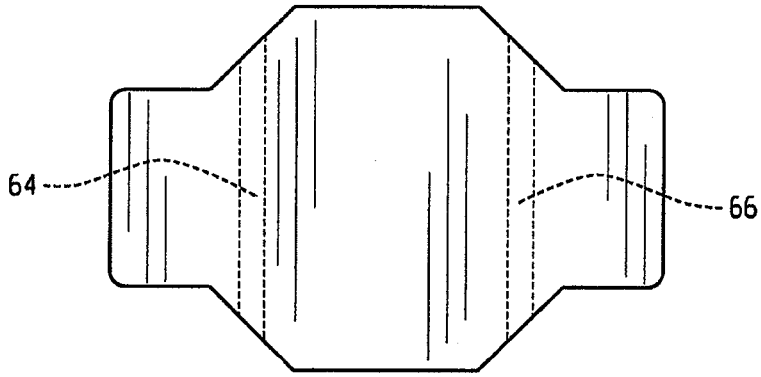
Figure 13:
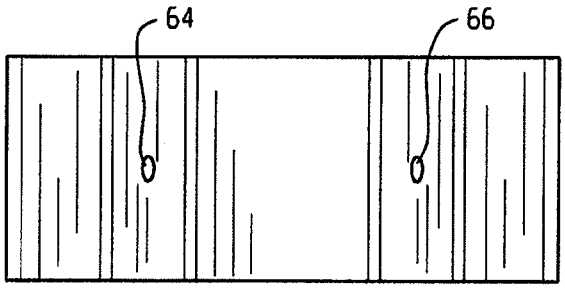
Figure 14:
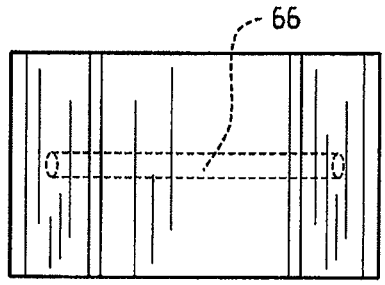
Figure 15:
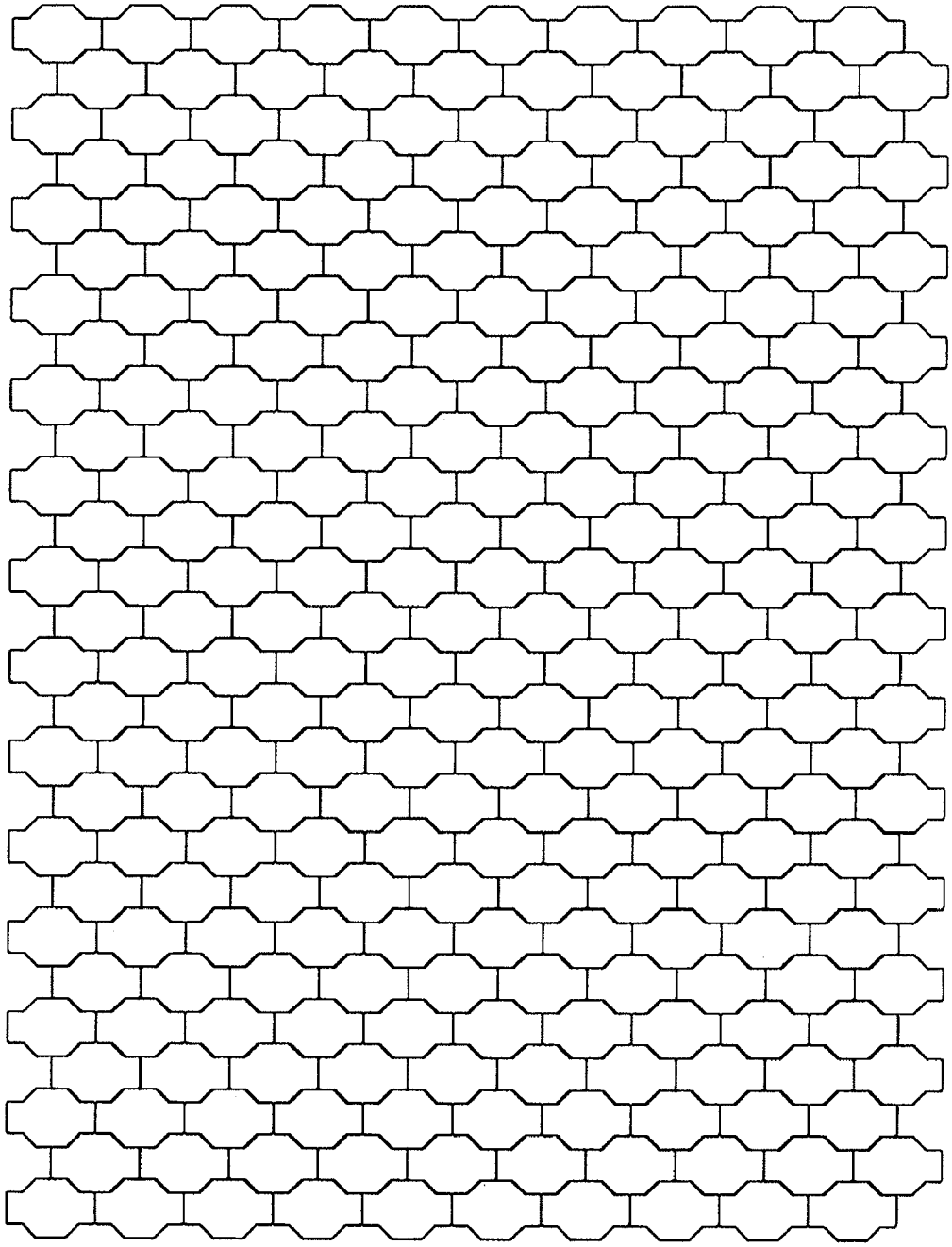
Figure 17:
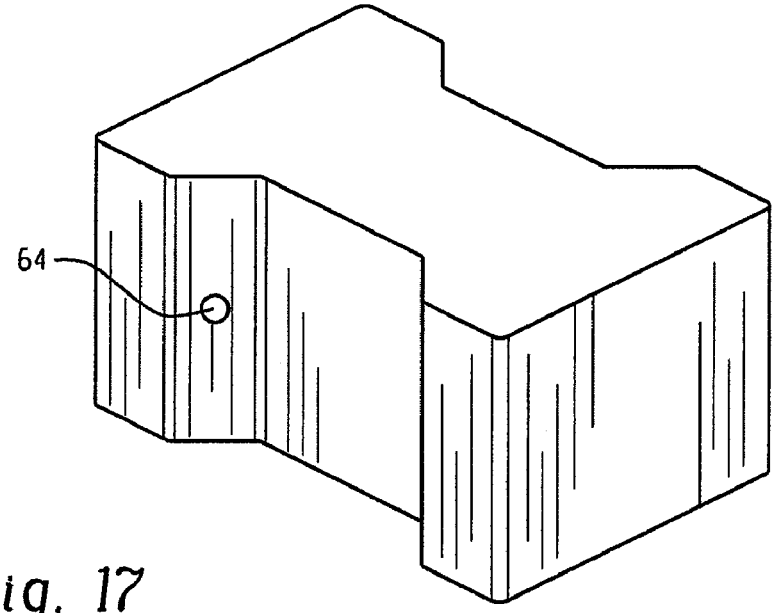
Figure 16:
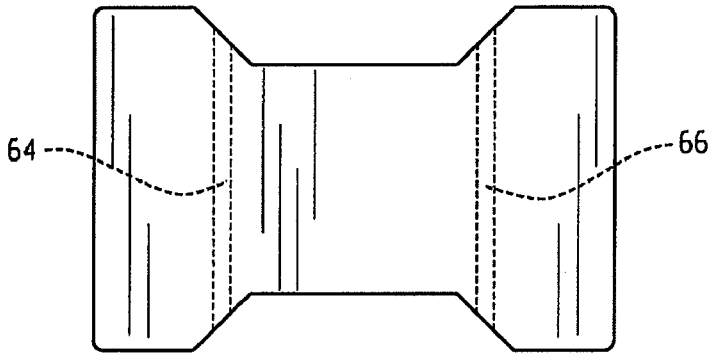
Figure 18:
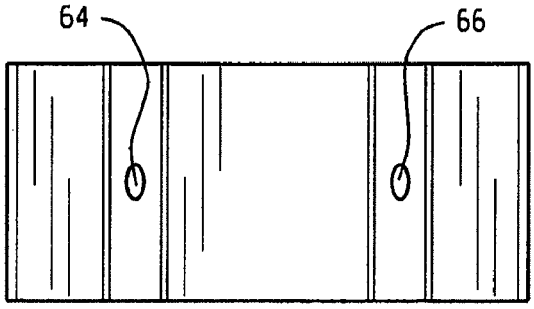
Figure 19:
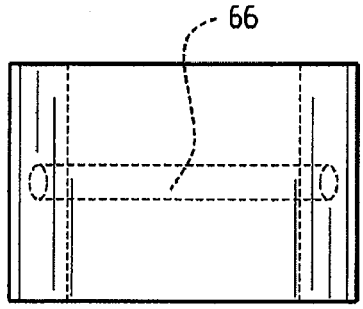
Figure 20:
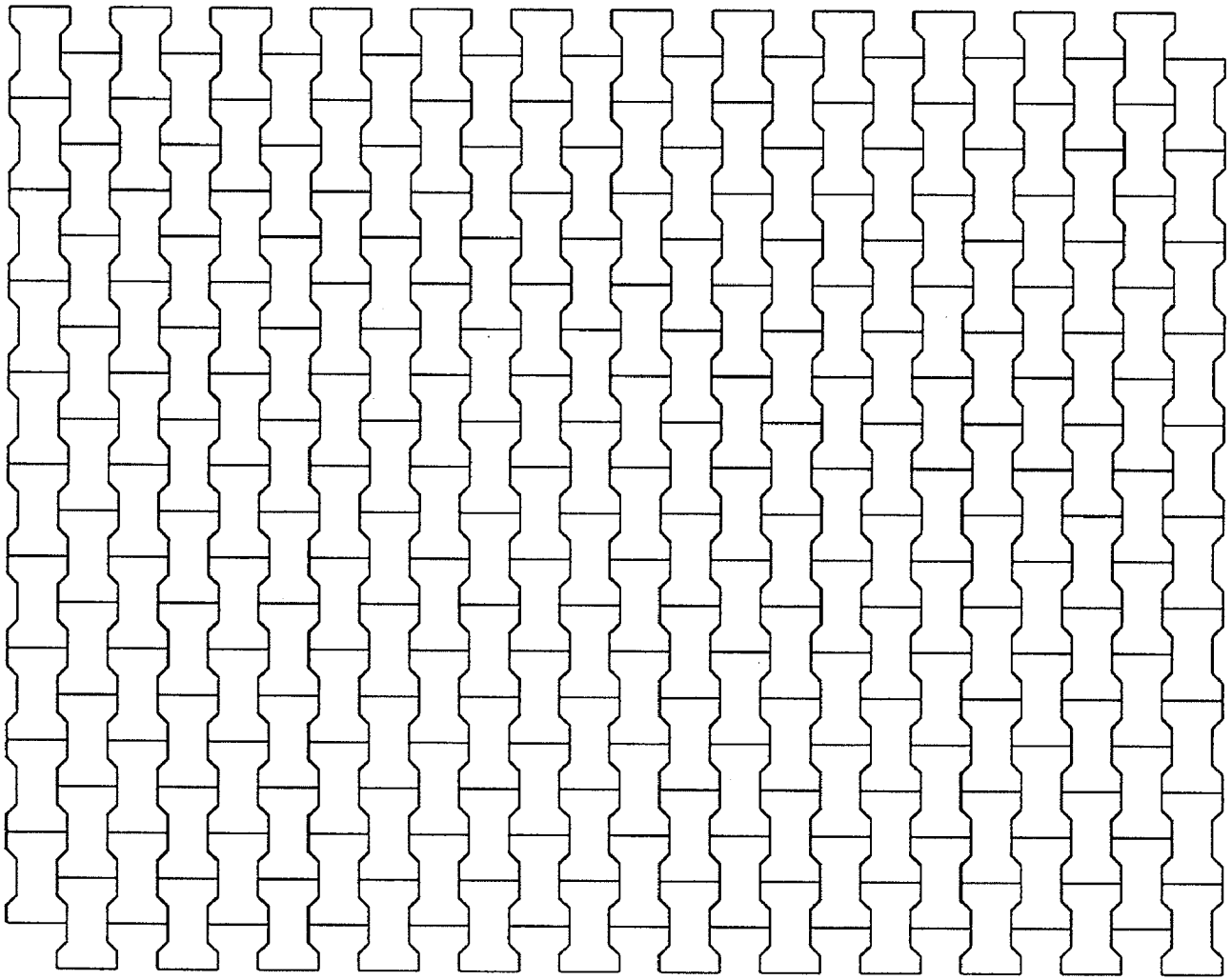

Referring now to FIGS. 9 and 10, an alternative embodiment of a mat system 54 is formed of section 56 and 58 connected end-to-end by removable blocks 30. The mat system 54 does not include sections connected side-by-side as described above. The removable blocks 30 may or may not include the center extension. In an alternative embodiment, the sections 56 and 58 of the mat system 54 may be subdivided into more sections in a fashion similar to that of FIG. 1. The removable blocks 30 of FIGS. 9 and 10 connecting the sections end-to-end also interconnect the side-by-side sections without use of removable blocks located between the row ends.

FIGS. 11-20 illustrate alternative block designs and mat systems formed using the alternative block designs. The blocks may have multiple openings 64 and 66 for receiving cables in a fashion similar to that described above. Interconnecting blocks may be used to interconnect mat units.

The above-described mat systems including removable blocks may be used in a variety of ways. As one example, mat systems 10 and 54 may be used to form a parking lot having a removable parking surface. One or more sections of the mat system 10, 54 can be moved to repair the earth thereunder due, for example, to heaving, which can minimize damage to the parking surface such as potholes and ruts. The mat systems 10 and 54 may be used to form temporary roadways, for example, for washed out roads or other emergency situations. The mat systems 10 and 54 may also be used to prevent or minimize soil erosion.

It is to be clearly understood that the above description is intended by way of illustration and example only and is not intended to be taken by way of limitation, and that changes and modifications are possible. For example, the cables may be tensioned. Referring to FIG. 8, the removable blocks may include a tool feature 60 (shown by dotted lines) on the upper surfaces thereof to facilitate vertical lifting. Referring to FIG. 2, while the cables 36 are shown running in one direction (e.g., north and south), the may run in two different directions, such as both north/south and east/west. Such a two-direction cable running arrangement may be desirable to interlock two mats laid side-by-side to create a wider temporary roadway. Accordingly, other embodiments are within the scope of the following claims.

What is claimed is:

1. A mat system, comprising:

a surface;

at least first and second mat units, each mat unit comprised of a respective plurality of blocks interlinked by respective cables that pass through the blocks, each mat unit including cable loops along at least one side section thereof, the first and second mat units positioned on the surface in proximity to each other with cable loops of the first mat unit extending toward the second mat unit and cable loops of the second mat unit extending toward the first mat unit;

a plurality of interconnecting blocks positioned between the first mat unit and the second mat unit and thereby connecting the first mat unit and the second mat unit, each interconnecting block including an underside with downwardly open channels formed therein, the cable loops of the first and second mat units positioned within the channels of the interconnecting blocks to cover the cable loops, the interconnecting blocks and the blocks forming the first and second mat units being sized, shaped and positioned such that upper surfaces thereof form a substantially continuous surface.

2. The mat system of claim 1, wherein the interconnecting blocks are individually removable via lifting vertically upward away from the surface.

3. The mat system of claim 1, wherein the interconnecting blocks include a tool feature on the upper surfaces thereof to facilitate vertical lifting.

4. The mat system of claim 1, wherein at least one interconnecting block includes a first extension extending downwardly from an underside of the at least one interconnecting block and adjacent at least one of the channels such that the first extension engages a first one of the cable loops of the first mat unit.

5. The mat system of claim 4, wherein the at least one interconnecting block includes a second extension extending downwardly from an underside of the at least one interconnecting block and adjacent at least one of the channels such that the second extension of the at least one interconnecting block engages a second one of the cable loops of the second mat unit.

6. The mat system of claim 5, wherein the at least one interconnecting block includes a third extension extending downwardly from an underside of the at least one interconnecting block and adjacent at least one of the channels such that the third extension engages a third one of the cable loops of the first mat unit.

7. The mat system of claim 6, wherein the at least one interconnecting block includes a fourth extension extending downwardly from an underside of the at least one interconnecting block and adjacent at least one of the channels such that the fourth extension of the at least one interconnecting block engages a fourth one of the cable loops of the second mat unit.

8. The mat system of claim 1, wherein the cable loops are each formed by a bend in the respective cables each having a first leg that is interconnected to a second leg by the bend, the first and second legs passing through first and second openings formed in more than one of the plurality of blocks.

9. The mat system of claim 1, wherein removal of the plurality of interconnecting blocks positioned between the first mat unit and the second mat unit disconnects the first mat unit from the second mat unit such that the first mat unit and the second mat unit can be separated from each other.

10. The mat system of claim 1 wherein the underside of each interconnecting block includes a first T-shaped channel and a second T-shaped channel separated a central downward extension.

11. The mat system of claim 1, wherein the mat system forms a temporary driving surface.

12. A method of forming a mat system, comprising:

forming a plurality of mat units by arranging blocks in multiple rows and interconnecting the blocks using cables with cable loops being exposed at an edge of the mat units;

arranging the mat units end-to-end such that cable loops of the end-to-end mat units face each other;

placing an interconnecting block between the ends of the end-to-end mat units such that the interconnecting block releasably engages cable loops of the end-to-end mat units to inhibit lateral movement of the end-to-end mat units relative to each other.

13. The method of claim 12 further comprising arranging the mat units side-by-side such that exposed cable portions of the side-by-side mat units face each other; and placing a second interconnecting block between sides of the side-by-side mat units such; that the second interconnecting block releasably engages the exposed cable portions of the side-by-side mat units to inhibit lateral movement of the side-by-side mat units relative to each other.

14. The method of claim 13 further comprising disconnecting the side-by-side mat units by lifting the second interconnecting block from its position between the side-by-side mat units.

15. The method of claim 12 further comprising disconnecting the end-to-end mat units by lifting the interconnecting block from its position between the ends of the mat units.

16. A mat system, comprising:

a surface;

at least first and second mat units, each mat unit comprised of a respective plurality of blocks interlinked by respective cables that pass through the blocks, each mat unit including cable loops along at least one side section thereof, the first and second mat units positioned on the surface in proximity to each other with cable loops of the first mat unit extending toward the second mat unit and cable loops of the second mat unit extending toward the first mat unit;

a plurality of interconnecting blocks positioned between the first mat unit and the second mat unit and thereby connecting the first mat unit and the second mat unit, each interconnecting block including an underside with downwardly open channels formed therein, the cable loops of the first and second mat units positioned within the channels of the interconnecting blocks to cover the cable loops, the interconnecting blocks and the blocks forming the first and second mat units being sized, shaped and positioned such that upper surfaces thereof form a substantially continuous surface;

wherein at least one connecting block includes a first downward extension received within a first cable loop of the first mat unit, a second downward extension received within a second cable loop of the first mat unit, a third downward extension positioned within a first cable loop of the second mat unit and a fourth downward extension positioned with a second cable loop of the second mat unit.

17. The mat system of claim 16 wherein the at least one connecting block further includes a central downward extension, the first downward extension and third downward extension located to one side of the central downward extension and the second downward extension and fourth downward extension located on an opposite side of the central downward extension.

18. The mat system of claim 17 wherein the first cable loop of the first mat unit is aligned with and adjacent to the first cable loop of the second mat unit, and the second cable loop of the first mat unit is aligned with the second cable loop of the second mat unit.

19. The mat system of claim 16 wherein the underside of each interconnecting block includes a first T-shaped channel and a second T-shaped channel separated a central downward extension.

* * * * *